US006888425B2

(12) United States Patent
Matsui et al.

(10) Patent No.: US 6,888,425 B2
(45) Date of Patent: May 3, 2005

(54) RESONATOR, FILTER, COMPOSITE FILTER, TRANSMITTING AND RECEIVING APPARATUS, AND COMMUNICATION APPARATUS

(75) Inventors: Norifumi Matsui, Kyoto (JP); Yuji Kintaka, Omihachiman (JP)

(73) Assignee: Murata Manufacturing Co. Ltd. (JP)

( * ) Notice: Subject to any disclaimer, the term of this patent is extended or adjusted under 35 U.S.C. 154(b) by 65 days.

(21) Appl. No.: 10/414,018

(22) Filed: Apr. 16, 2003

(65) Prior Publication Data

US 2003/0227349 A1 Dec. 11, 2003

(30) Foreign Application Priority Data

Apr. 16, 2002 (JP) ..... 2002-113963

(51) Int. Cl.[7] ..... H01P 7/08; H01P 1/203; H01B 12/02

(52) U.S. Cl. ..... 333/219; 333/202; 333/204; 333/99 S; 333/210

(58) Field of Search ..... 333/99 S, 204, 333/203, 134, 219, 222, 205, 202, 210; 331/219, 238, 219.1, 202, 204, 205; 327/552

(56) References Cited

U.S. PATENT DOCUMENTS 5,616,538 A * 4/1997 Hey-Shipton et al. ..... 505/210
6,463,308 B1 * 10/2002 Wikborg et al. ..... 505/210
6,603,373 B2 * 8/2003 Tsujiguchi ..... 333/204

FOREIGN PATENT DOCUMENTS

JP 04-187747 7/1992
JP 04-191835 7/1992

* cited by examiner

*Primary Examiner*—Dinh T. Le
(74) *Attorney, Agent, or Firm*—Dickstein, Shapiro, Morin & Oshinsky, LLP.

(57) ABSTRACT

A microstrip resonator including a dielectric substrate, a resonance electrode on a first main surface of the dielectric substrate, and a ground electrode over an entire second main surface of the dielectric substrate. The resonance electrode includes a superconducting film and a metal film deposited in that order. The ground electrode includes a superconducting film and a metal film deposited in that order. The superconducting film functions as an electrode in low-temperature operation below a critical temperature, and the metal film functions as an electrode in high-temperature operation at or above the critical temperature. The length of the superconducting film of the resonance electrode is set to be longer than that of the metal film of the resonance electrode, so that the resonance frequency in low-temperature operation is substantially equal to the resonance frequency in high-temperature operation.

15 Claims, 18 Drawing Sheets

(a)

(b)

RESONATOR, FILTER, COMPOSITE FILTER, TRANSMITTING AND RECEIVING APPARATUS, AND COMMUNICATION APPARATUS

BACKGROUND OF THE INVENTION

1. Field of the Invention

The present invention relates to resonators, filters, duplexers, composite filter apparatuses, and transmitting and receiving apparatuses that are used in RF circuits of communication equipment, and to communication apparatuses that use the resonators, the filters, the duplexers, the composite filter apparatuses, and the transmitting and receiving apparatuses.

2. Description of the Related Art

Generally, resonators such as dielectric resonators provided with electrodes on dielectrics are used for microwave communication. The dielectric resonators are, for example, microstrip resonators and dielectric coaxial resonators.

Along with the improved performance of communication apparatuses, low-loss characteristics of resonators are becoming more important. Dielectric resonators in which superconductors are used as electrodes have low conductor loss. For such resonators, however, in order to maintain low-loss characteristics, the temperature must always be lower than the critical temperature at which the electrodes become superconductive. Thus, the resonators must always be cooled by refrigerators. For example, a failure to cool the resonators due to a malfunction of the refrigerator, however, causes the temperature of the resonator electrodes to exceed the critical temperature. Thus, the conductance of the superconductor becomes much lower than that of metals, which are normally used as electrode materials, and also, the resistance of the superconductor is increased. Therefore, the conductor loss of the resonators is increased.

Microstrip dielectric resonators for solving such problems are disclosed in Japanese Unexamined Patent Application Publication Nos. 6-37513 and 6-37514.

Referring to FIGS. 17A, 17B, and 17C, in these microstrip dielectric resonators, a resonance electrode 2 with a predetermined width and length is formed on a first main surface of a dielectric substrate 1 and a ground electrode 3 is formed over an entire second main surface of the dielectric substrate 1. The resonance electrode 2 comprises a superconducting film 21 and a metal film 22 deposited in that order, and the ground electrode 3 comprises a superconducting film 31 and a metal film 32 deposited in that order. In such dielectric resonators, the superconducting film 21 operates as a main resonance electrode in low-temperature operation below the critical temperature, and the metal film 22 operates as a main resonance electrode in high-temperature operation at or above the critical temperature. Accordingly, reduction of conductor loss in the normal temperature range can be suppressed.

Such conventional low-loss dielectric resonators, however, have the following problems.

The surface reactance of superconductors for RF signals significantly differs between the superconductive state in low-temperature operation below the critical temperature and the non-superconductive state in high-temperature operation at or above the critical temperature. Thus, the resonance frequency of the resonators significantly differs between the superconductive state and the non-superconductive state, as shown in FIG. 18.

FIG. 18 is a graph showing the temperature characteristics of the resonance frequency of a dielectric resonator using a layered electrode comprising a superconductor and a metal.

As shown in FIG. 18, although the resonance frequency gradually decreases in both the superconductive state and non-superconductive state as the temperature increases, the resonance frequency significantly drops when the state changes from the superconductive state to the non-superconductive state. As described above, the resonance frequency is completely changed at the critical temperature. If, for example, a band pass filter is formed by such a resonator, the width of the pass band varies with temperature, and the transmission characteristics are thus disadvantageously dependent on temperature.

SUMMARY OF THE INVENTION

Accordingly, it is an object of the present invention to arrange a low-loss resonator having a constant resonance frequency independent of critical temperature.

In order to achieve the above object, a resonator according to an aspect of the present invention includes a dielectric and a layered electrode formed on the dielectric. The layered electrode includes a superconducting film and a metal film. The resonance frequency is determined depending on at least one of the position, shape, and size of the layered electrode. At least one of the position, shape, and size of each of the superconducting film and the metal film is determined so that a resonance frequency in low-temperature operation below a critical temperature at which the superconducting film operates as a main conductor is substantially equal to a resonance frequency in high-temperature operation at or above the critical temperature at which the metal film operates as a main conductor.

The term "resonance frequencies are substantially equal" means a state in which a variation between the resonance frequency in low-temperature operation and the resonance frequency in high-temperature operation of a resonator is smaller than a variation between the resonance frequency in low-temperature operation and the resonance frequency in high-temperature operation of a resonator having the same configuration with the exception that a superconducting film and a metal film of equal area are formed at the same position.

Thus, the change in the resonance frequency due to the change in the surface reactance of the superconducting film for an RF signal is compensated for by making the metal film operate as a conductor when the superconducting film is shifted from a superconductive state to a non-superconductive state. Moreover, setting the resonance frequency in low-temperature operation below the critical temperature to be substantially equal to the resonance frequency in high-temperature operation at or above the critical temperature allows the resonator to be usable over a wide temperature range.

The area of the metal film may be smaller than the area of the superconducting film. When the superconducting film is shifted from the superconductive state to the non-superconductive state, the metal film operates as a main conductor in a temperature range at which the resonance frequency decreases due to the change in the surface reactance of the superconducting film for an RF signal. Accordingly, the reduction in the resonance frequency can be compensated for, thus allowing the resonance frequency of the resonator to be substantially constant over a wide temperature range. Also, the electrode formation can be readily performed.

A resonator according to another aspect of the present invention includes a dielectric and an electrode formed on the dielectric. The electrode includes a superconducting film and a composite electrode film composed of a mixture of a superconductor and a metal. The resonance frequency is determined depending on at least one of the position, shape, and size of the electrode. At least one of the position, shape, and size of each of the composite electrode film and the superconducting film is determined so that a resonance frequency in low-temperature operation below a critical temperature at which the superconductor of the composite electrode film and the superconducting film operate as a main conductor is substantially equal to a resonance frequency in high-temperature operation at or above the critical temperature at which the metal of the composite electrode film operates as a main conductor.

Thus, the change in the resonance frequency due to the change in the surface reactance of the superconductor is compensated for by making the metal of the composite electrode film operate as a conductor when the superconductor of the composite electrode film and the superconducting film are shifted from the superconductive state to the non-superconductive state. Moreover, setting the resonance frequency in low-temperature operation below the critical temperature to be substantially equal to the resonance frequency in high-temperature operation at or above the critical temperature allows the resonator to be usable over a wide temperature range. Also, no layered electrode is used, thus allowing a resonator having a simpler configuration.

The resonator may further include an additional electrode providing an additional capacitance, the additional electrode being composed of the superconducting film and being formed near an open end of the resonator. Thus, the resonance frequency in low-temperature operation below the critical temperature of the superconducting film can be readily set to the resonance frequency in high-temperature operation at which the metal film operates as a main conductor.

The additional electrode providing an additional capacitance may be composed of the metal film, the superconducting film, or the composite electrode film composed of a mixture of the superconductor and the metal. The resonator may further include a contact electrode connecting the additional electrode to the vicinity of an open end of the resonator, the contact electrode being composed of the superconducting film. Thus, the resonance frequency in low-temperature operation below the critical temperature of the superconducting film can be readily and precisely set to the resonance frequency in high-temperature operation at which the metal film operates as a main conductor.

The dielectric constant of the dielectric may exhibit a negative temperature coefficient. Thus, the temperature characteristics of the surface reactance of the superconducting film are cancelled out by the temperature characteristics of the dielectric constant of the dielectric. Therefore, the temperature dependency of the resonance frequency can be suppressed further.

A filter according to the present invention includes a plurality of pairs of resonators and a plurality of input-output units for coupling to the respective resonators. Thus, the attenuation characteristics of the filter are substantially constant over a wide temperature range.

A duplexer according to the present invention includes a plurality of pairs of resonators and a plurality of input-output units for coupling to the respective resonators. Thus, the attenuation characteristics of the duplexer are substantially constant over a wide temperature range.

A composite filter apparatus according to the present invention includes a plurality of pairs of filters or a plurality of pairs of duplexers. Thus, the attenuation characteristics are substantially constant over a wide temperature range.

A transmitting and receiving apparatus according to the present invention includes the filter, the duplexer, or the composite filter apparatus; an amplifier connected to an input unit or an output unit of the filter, the duplexer, or the composite filter apparatus; and a refrigerator. Thus, the transmitting and receiving apparatus has stable transmission characteristics. Here, the transmitting and receiving apparatus includes a transmitting apparatus performing only transmission and a receiving apparatus performing only reception, as well as an apparatus having a transmitting function and a receiving function.

A communication apparatus according to the present invention includes the filter, the duplexer, the composite filter apparatus, or the transmitting and receiving apparatus. Thus, the communication apparatus has stable communication characteristics.

DESCRIPTION OF THE PREFERRED EMBODIMENTS

The configuration of a microstrip resonator according to a first embodiment of the present invention will be described with reference to FIGS. 1A, 1B, 1C and 2.

Figure 1A:
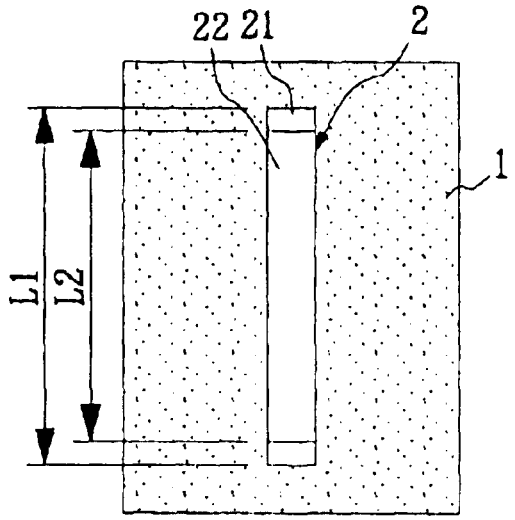
FIG. 1A is a top view of a microstrip resonator according to a first embodiment of the present invention.
Figure 1B:
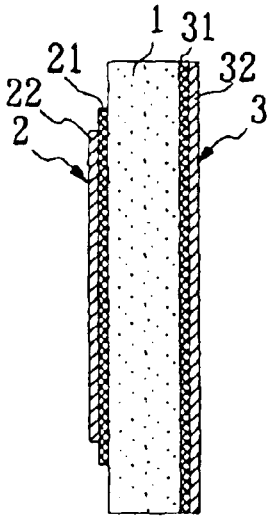
FIG. 1B is a sectional view of the microstrip resonator taken along the longitudinal direction.
Figure 1C:
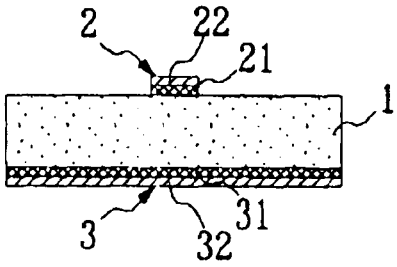
FIG. 1C is a sectional view of the microstrip resonator taken along the lateral direction.

FIG. 1A is a top view of the microstrip resonator. FIG. 1B is a sectional view of the microstrip resonator taken along the longitudinal direction. FIG. 1C is a sectional view of the microstrip resonator taken along the lateral direction.

Referring to FIGS. 1A to 1C, a resonance electrode 2 is formed on a first main surface of a dielectric substrate 1. The resonance electrode 2 comprises an electrode film 21 made of a superconductor (hereinafter, referred to as a superconducting film 21) having a longitudinal length L1 and an electrode film 22 made of a metal (hereinafter, referred to as a metal film 22) having a longitudinal length L2 deposited in that order from the first main surface of the dielectric substrate 1. The length L1 of the superconducting film 21 is greater than the length L2 of the metal film 22. Thus, the superconducting film 21 protrudes from both ends in the longitudinal direction of the metal film 22.

A ground electrode 3 is formed over an entire second main surface of the dielectric substrate 1. The ground electrode 3 comprises an electrode film 31 made of a superconductor (hereinafter, referred to as a superconducting film 31) and an electrode film 32 made of a metal (hereinafter, referred to as a metal film 32) deposited in that order.

The longitudinal length of the resonance electrode 2 is an integral multiple of half the wavelength at the operating frequency, so that the microstrip resonator in which both ends in the longitudinal direction of the resonance electrode 2 are open is formed.

The superconducting films 21 and 31 are preferably composed of a Cu-containing oxide superconductor, for example, $Y_1Ba_2Cu_3O_x$, $(Bi,Pb)_2Sr_2Ca_2Cu_3O_x$, or $Bi_2Sr_2Ca_1Cu_2O_x$. Since the critical temperature of such a Cu-containing oxide superconductor is approximately 100 K, which is relatively high among superconductor materials, use of, for example, a Stirling refrigerator, a GM refrigerator, a pulse-tube refrigerator, or a refrigerator having a predetermined performance such as a Peltier element enables the superconducting films 21 and 31 to become superconductive relatively easily.

The metal films 22 and 32 are made of, for example, Ag, Au, Pt, Cu, or Al.

The dielectric substrate 1 is made of, for example, MgO, $Al_2O_3$, $LaAlO_3$, $Ba(Mg,Ta)O_3$, $Ba(Sn,Mg,Ta)O_3$, $Ba(Mg,Nb)O_3$, or $Ba(Zn,Nb)O_3$.

For a resonator having a resonance frequency of 2 GHz with the configuration described above, it is desirable that the superconducting films 21 and 31 have a thickness of 0.2 to 10 $\mu$m, and that the metal films 22 and 32 have a thickness of 1 $\mu$m or more. It is also desirable that the thickness of the superconducting films 21 and 31 be approximately one to two times as large as the electromagnetic field penetration depth (London penetration depth) of the superconductor.

If the length L1 of the superconducting film 21 is equal to the length L2 of the metal film 22, the resonance frequency changes by df at the critical temperature. Here, the length L1 of the superconducting film 21 is set to be greater than the length L2 of the metal film 22. More specifically, the rate of increase of the length L1 with respect to the length L2 is equal to the rate of frequency change df/fo, where fo represents the resonance frequency at the critical temperature in the superconductive state. Accordingly, the change in the resonance frequency due to the change in the surface reactance of the superconducting films 21 and 31 is compensated for by making the metal film 22 operate as a main conductor when the superconducting films 21 and 31 are shifted from the superconductive state to the non-superconductive state. Moreover, the resonance frequency in low-temperature operation below the critical temperature is set to be equal to the resonance frequency in high-temperature operation at or above the critical temperature.

For example, if a resonator has a resonance frequency of 2 GHz in the superconductive state and the resonance frequency decreases by 4 MHz at the critical temperature in the non-superconductive state, the length L1 of the superconducting film 21 is set to be greater than the length L2 of the metal film 22 by 0.2%.

Figure 2:
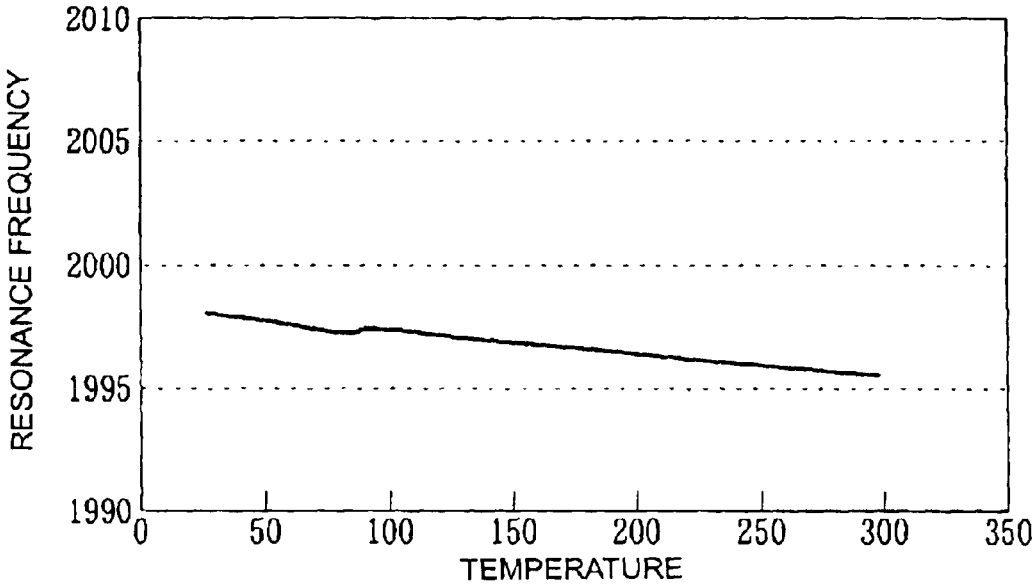
FIG. 2 is a graph showing the temperature characteristics of the resonance frequency of the resonator according to the first embodiment.

FIG. 2 shows the temperature characteristics of the resonance frequency of a resonator formed as described above. As shown in FIG. 2, the resonance frequency in the superconductive state decreases, and is substantially constant before and after the critical temperature.

A microstrip resonator in which the resonance frequency is not dependent on temperature can thus be formed, as described above.

The configuration of a microstrip resonator according to a second embodiment of the present invention will now be described with reference to FIGS. 3 and 4.

Figure 3:
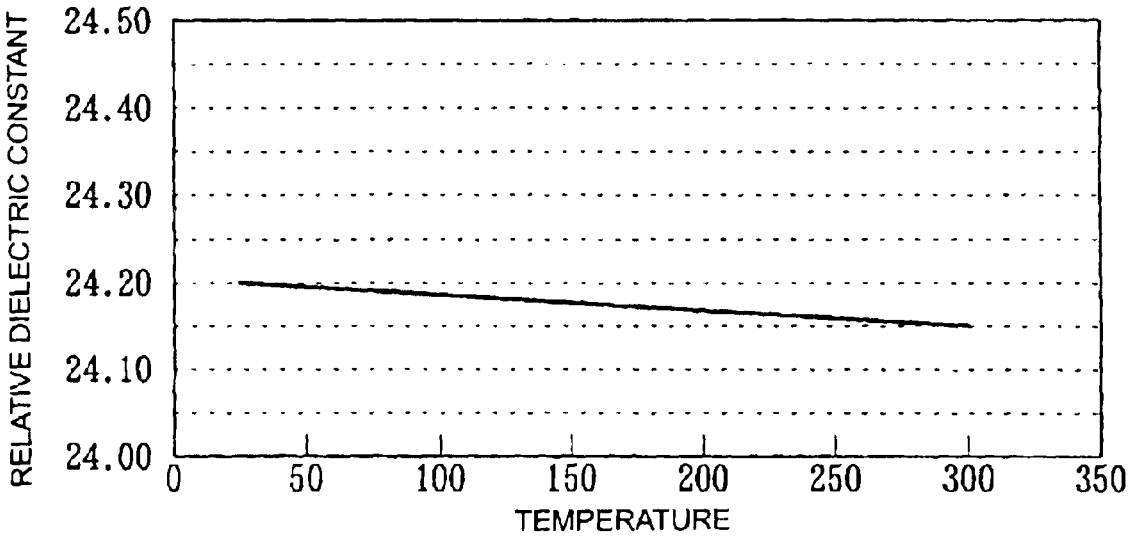
FIG. 3 is a graph showing the temperature characteristics of the dielectric constant of a dielectric used in a resonator according to a second embodiment of the present invention.
Figure 4:
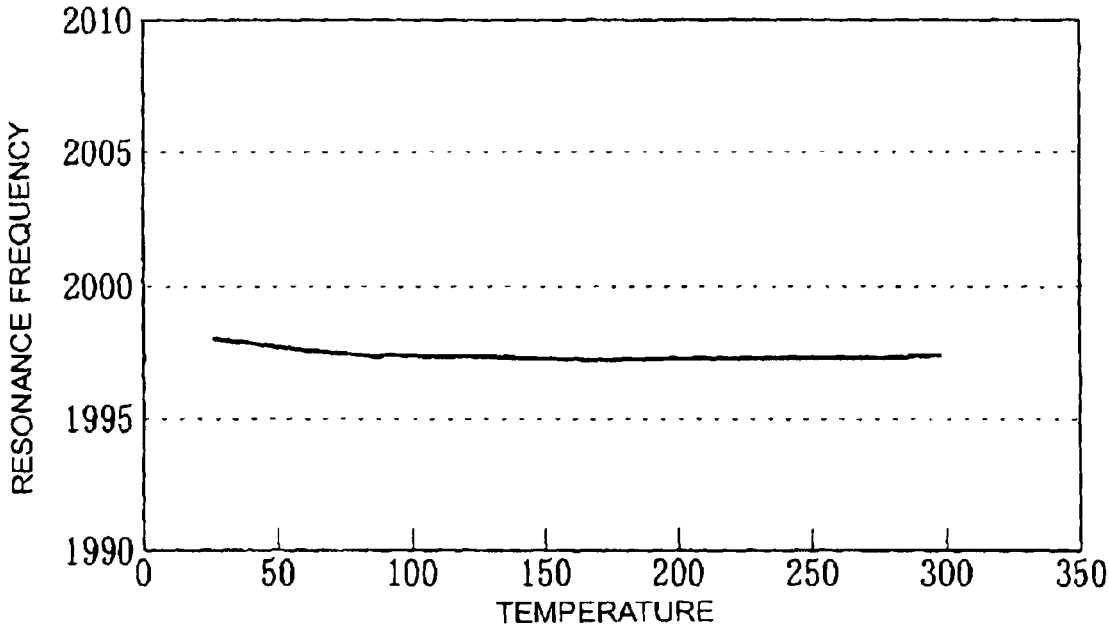
FIG. 4 is a graph showing the temperature characteristics of the resonance frequency of the resonator according to the second embodiment.

FIG. 3 shows the temperature characteristics of the dielectric constant of a dielectric used in the second embodiment. FIG. 4 shows the temperature characteristics of the resonance frequency of the resonator.

The configuration of the microstrip resonator according to the second embodiment is the same as in the first embodiment with the exception of the materials of the dielectric substrate 1. More specifically, only the temperature characteristics of the dielectric constant of the dielectric constituting the dielectric substrate 1 are different from those of the first embodiment.

The temperature coefficient of the dielectric constant of the dielectric used in the second embodiment is negative. For example, the temperature coefficient is −8 ppm/K, as shown in FIG. 3.

For a dielectric having such a negative temperature coefficient, $Ba(Mg,Ta)O_3$, Ba(Sn,Mg,Ta)O3, $Ba(Mg,Nb)O_3$, $Ba(Zn,Nb)O_3$, and mixtures thereof may be used. Despite similarity of the composition, these dielectric materials have different temperature coefficients. Thus, mixing them allows a dielectric having a predetermined temperature coefficient to be produced.

The dielectric constant of the dielectric of the resonator according to the first embodiment does not have a temperature coefficient. Thus, as shown in FIG. 2, although the resonance frequency does not greatly change at the critical temperature and is substantially constant before and after the critical temperature, the resonance frequency decreases on the whole as the temperature increases.

In contrast, the dielectric constant of the dielectric of the microstrip resonator according to the second embodiment has a negative temperature coefficient. Thus, the dielectric constant decreases as the temperature increases, resulting in an increase in the resonance frequency of the resonator. It is therefore desirable that the temperature coefficient of the dielectric constant of the dielectric used in the dielectric substrate 1 be appropriately determined so that a substantially constant resonance frequency can be achieved even if the temperature of the entire resonator varies over a wide range, as shown in FIG. 4.

The configuration of a microstrip resonator according to a third embodiment of the present invention will now be described with reference to FIGS. 5A, 5B, and 5C.

Figure 5A:
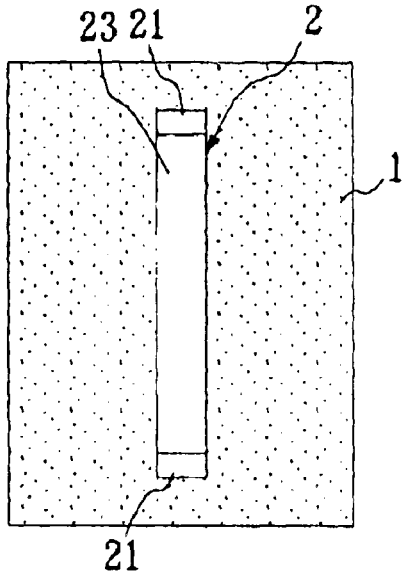
FIG. 5A is a top view of a microstrip resonator according to a third embodiment of the present invention.
Figure 5B:
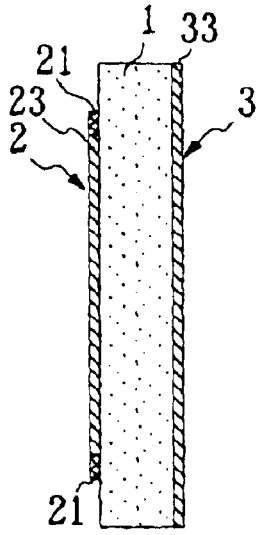
FIG. 5B is a sectional view of the microstrip resonator taken along the longitudinal direction.
Figure 5C:
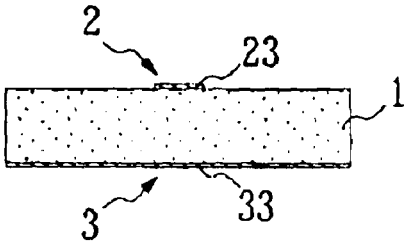
FIG. 5C is a sectional view of the microstrip resonator taken along the lateral direction.

FIG. 5A is a top view of the microstrip resonator. FIG. 5B is a sectional view of the microstrip resonator taken along the longitudinal direction. FIG. 5C is a sectional view of the microstrip resonator taken along the lateral direction.

The dielectric, superconductor, and metal used in the third embodiment are the same as in the first embodiment.

The resonance electrode 2 is formed on a first main surface of the dielectric substrate 1. The resonance electrode 2 comprises a composite electrode film 23 having a predetermined longitudinal length and the superconducting films 21 having a predetermined length and connected to ends of the composite electrode film 23. The composite electrode film 23 is composed of a superconductor and a metal. The ground electrode 3 is formed over an entire second main surface of the dielectric substrate 1. The ground electrode 3 comprises a composite electrode film 33 composed of a superconductor and a metal.

The longitudinal length of the resonance electrode 2 is an integral multiple of half the wavelength at the operating frequency, so that the microstrip resonator in which both ends in the longitudinal direction of the resonance electrode 2 are open is formed.

The dielectric substrate 1 and the superconducting films 21 are composed of the materials shown in the first embodiment. The composite electrode films 23 and 33 are composed of a mixture of the superconductor materials and the metal shown in the first embodiment.

With the configuration described above, the resonator operates in such a manner that the superconductor of the composite electrode film 23 and the superconducting films 21 operate as main conductors in low-temperature operation below the critical temperature and the metal of the composite electrode film 23 operates as a main conductor in high-temperature operation at or above the critical temperature. The dimensions of the composite electrode film 23 and the dimensions of the superconducting films 21 disposed at both ends of the composite electrode film 23 are set so that the resonance frequency in low-temperature operation is substantially equal to the resonance frequency in high-temperature operation.

Thus, a resonator having a resonance frequency that is not dependent on temperature can be formed. Also, since a layered electrode is not used, a resonator to having a simpler configuration can be readily formed.

The configuration of an open circular TM mode resonator according to a fourth embodiment of the present invention will now be described with reference to FIGS. 6A and 6B.

Figure 6A:
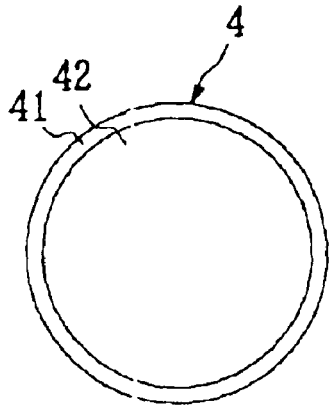
FIG. 6A is a top view of an open circular TM mode resonator according to a fourth embodiment of the present invention.
Figure 6B:
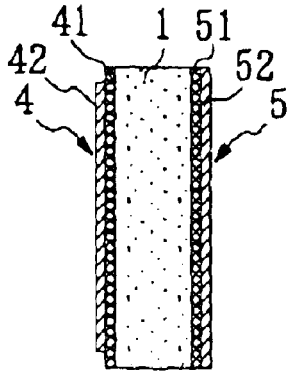
FIG. 6B is a side sectional view of the open circular TM mode resonator.

FIG. 6A is a top view of the open circular TM mode resonator, and FIG. 6B is a side sectional view of the open circular TM mode resonator.

The dielectric, superconductor, and metal used in the fourth embodiment are the same as in the first embodiment.

A top electrode 4 is formed on the top surface of the dielectric substrate 1, which is a first main surface of the dielectric substrate 1. The top electrode 4 comprises a superconducting film 41 and a metal film 42 deposited in that order. A bottom electrode 5 is formed on the bottom surface of the dielectric substrate 1, which is a second main surface of the dielectric substrate 1. The bottom electrode 5 comprises a superconducting film 51 and a metal film 52 deposited in that order.

The dielectric substrate 1, the superconducting films 41 and 51, and the metal films 42 and 52 are composed of the materials shown in the first embodiment.

Since the superconducting films 41 and 51 operate as main conductors in low-temperature operation below the critical temperature and the metal films 42 and 52 operate as main conductors in high-temperature operation at or above the critical temperature, the area of the superconducting film 41 of the top electrode 4 is set to be greater than that of the metal film 42 so that the resonance frequency in low-temperature operation is substantially equal to the resonance frequency in high-temperature operation. Thus, an open circular TM mode resonator having a resonance frequency that is not dependent on temperature can be achieved.

Although a circular resonator is described in the fourth embodiment, a rectangular or polygonal resonator can also realize similar advantages, by setting the area of the superconducting film to be greater than that of the metal film.

The configuration of a dielectric coaxial resonator according to a fifth embodiment of the present invention will now be described with reference to FIGS. 7A and 7B.

Figure 7A:
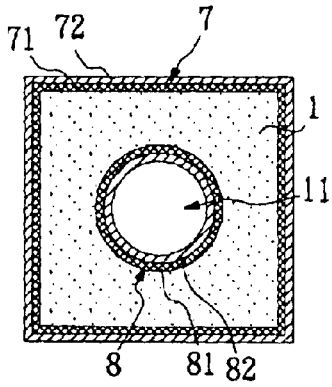
FIG. 7A is a sectional view of a dielectric coaxial resonator according to a fifth embodiment of the present invention taken perpendicularly to the axial direction of a through-hole.

FIG. 7A is a sectional view of the dielectric coaxial resonator taken perpendicularly to the axial direction of a through-hole 11. FIG. 7B is a sectional view of the dielectric coaxial resonator taken parallel to the axis of the through-hole 11.

The dielectric, superconductor, and metal used in the fifth embodiment are the same as in the first embodiment.

The through-hole 11 extends from a surface of the dielectric substrate 1 to an opposing surface. An inner conductor 8 is formed on the inner surface of the through-hole 11. The inner conductor 8 comprises a superconducting film 81 and a metal film 82 deposited in that order. The length of the through-hole 11, that is, the length of the dielectric substrate 1 in the axial direction of the through-hole 11 is equal to half the wavelength at the operating frequency. Also, an outer conductor 7 is formed on four outer surfaces of the dielectric substrate 1 other than the two surfaces in which the through-hole 11 is formed. The outer conductor 7 comprises a superconducting film 71 and a metal film 72 deposited in that order. Thus, a dielectric coaxial resonator having a length of half the wavelength at the operating frequency, wherein the through-hole 11 is formed having both ends open, can be realized.

The superconducting film 81 of the inner conductor 8 is formed over the entire inner surface of the through-hole 11. In contrast, the metal film 82 is not formed on the inner surface from surfaces in which the through-hole 11 is formed to positions at a predetermined depth from the surfaces. By this arrangement, the area of the superconducting film 81 is set to be greater than the area of the metal film 82 so that the resonance frequency in low-temperature operation is substantially equal to the resonance frequency in high-temperature operation, as in the embodiments described above. Thus, a dielectric coaxial resonator having a resonance frequency that is not dependent on temperature can be achieved.

The configuration of a dielectric coaxial resonator according to a sixth embodiment of the present invention will now be described with reference to FIGS. 8A and 8B.

Figure 8A:
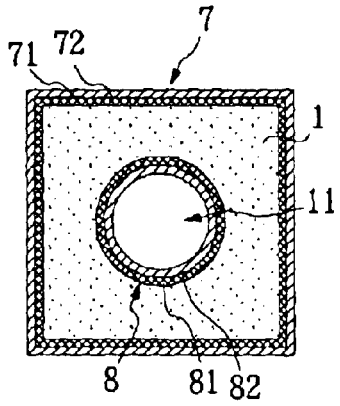
FIG. 8A is a sectional view of a dielectric coaxial resonator according to a sixth embodiment of the present invention taken perpendicularly to the axial direction of a through-hole.

FIG. 8A is a sectional view of the dielectric coaxial resonator taken perpendicularly to the axial direction of the through-hole 11. FIG. 8B is a sectional view of the dielectric coaxial resonator taken parallel to the axis of the through-hole 11.

The dielectric, superconductor, and metal used in the sixth embodiment are the same as in the first embodiment.

The through-hole 11 extends from a surface of the dielectric substrate 1 to an opposing surface. The inner conductor 8 is formed on the inner surface of the through-hole 11. The inner conductor 8 comprises the superconducting film 81 and the metal film 82 deposited in that order. The length of the through-hole 11, that is, the length of the dielectric substrate 1 in the axial direction of the through-hole 11 is equal to one quarter the wavelength at the operating frequency. The outer conductor 7 is formed on five outer surfaces of the dielectric substrate 1 other than the single surface in which the through-hole 11 is formed. The outer conductor 7 comprises the superconducting film 71 and the metal film 72 deposited in that order. Thus, a dielectric coaxial resonator having a length of one quarter the wavelength at the operating frequency, one surface in which the through-hole 11 is formed being open and the other surface in which the through-hole 11 is formed being short circuited, can be realized.

The superconducting film 81 of the inner conductor 8 is formed over the entire inner surface of the through-hole 11. In contrast, the metal film 82 is not formed on the inner surface from the open surface in which the through-hole 11 is formed to a position at a predetermined depth from the open surface. Accordingly, the area of the superconducting film 81 is set to be greater than the area of the metal film 82. Thus, the resonance frequency can be readily adjusted, and a dielectric coaxial resonator having a resonance frequency that is not dependent on temperature can be formed, as in the fifth embodiment.

The configuration of a dielectric coaxial resonator according to a seventh embodiment of the present invention will now be described with reference to FIGS. 9A and 9B.

Figure 9A:
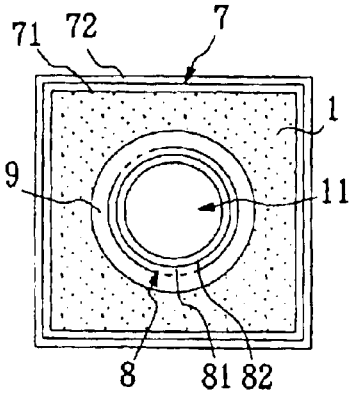
FIG. 9A is a front view showing one open surface of a dielectric coaxial resonator according to a seventh embodiment of the present invention in which a through-hole is formed.
Figure 9B:
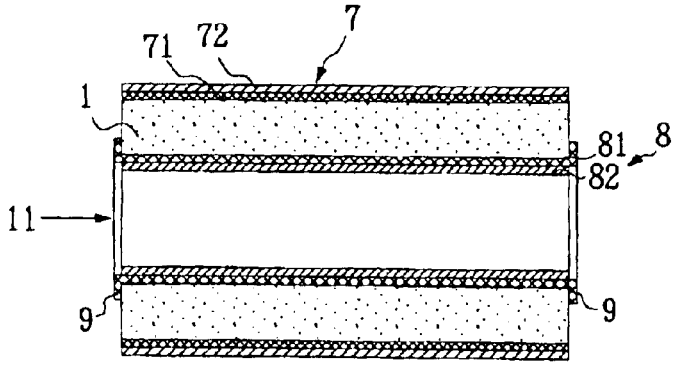
FIG. 9B is a sectional view of the dielectric coaxial resonator taken parallel to the axis of the through-hole.

FIG. 9A is a front view showing one open surface of the dielectric coaxial resonator in which the through-hole 11 is formed, and FIG. 9B is a sectional view of the dielectric coaxial resonator taken parallel to the axis of the through-hole 11.

Figure 7B:
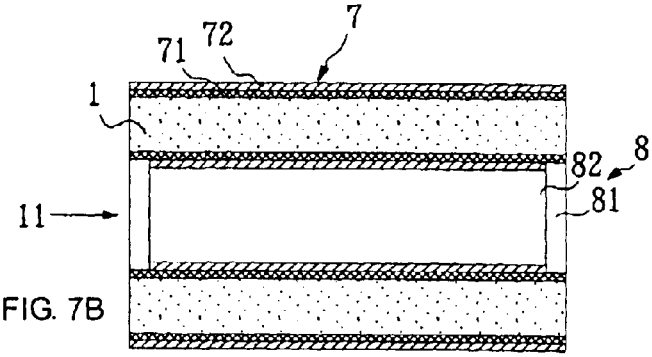
FIG. 7B is a sectional view of the dielectric coaxial resonator taken parallel to the axis of the through-hole.

In FIGS. 9A and 9B, reference numeral 9 represents an additional electrode, and the same parts as in FIGS. 7A and 7B are referred to with the same reference numerals.

The dielectric, superconductor, and metal used in the seventh embodiment are the same as in the first embodiment.

In the dielectric coaxial resonator shown in FIGS. 9A and 9B, the additional electrodes 9 electrically connected to the inner conductor 8 are formed on both the surfaces in which the through-hole 11 is formed (open surfaces), and the superconducting film 81 and the metal film 82 are formed over the entire inner surface of the through-hole 11. The other configuration is the same as in the dielectric coaxial resonator shown in FIGS. 7A and 7B. Each of the additional electrodes 9 is composed of a superconductor. Since each of the additional electrodes 9 formed as described above causes an additional capacitance, the resonance frequency in low-temperature operation below the critical temperature of the superconducting film is set to the resonance frequency in high-temperature operation at which the metal film operates as a main conductor.

Since the area of the additional electrodes 9 can be set to any size on the open surfaces, the resonance frequency in low-temperature operation can be readily set. Thus, a resonance frequency can be readily adjusted, and a dielectric coaxial resonator having a resonance frequency that is not dependent on temperature can be readily formed.

Although the additional electrode is provided on each of the surfaces in which the through-hole is formed in the seventh embodiment, providing the additional electrode only on one surface in which the through-hole is formed can also achieve similar advantages by setting the area of the additional electrode to a predetermined size.

The configuration of a dielectric coaxial resonator according to an eighth embodiment of the present invention will now be described with reference to FIGS. 10A and 10B.

Figure 10A:
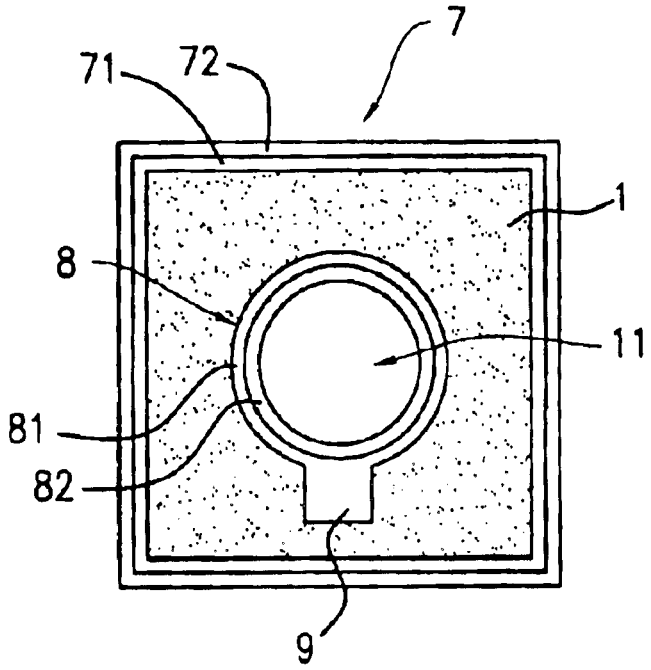
FIG. 10A is a front view showing an open surface of a dielectric coaxial resonator according to an eighth embodiment of the present invention in which a through-hole is formed.
Figure 10B:
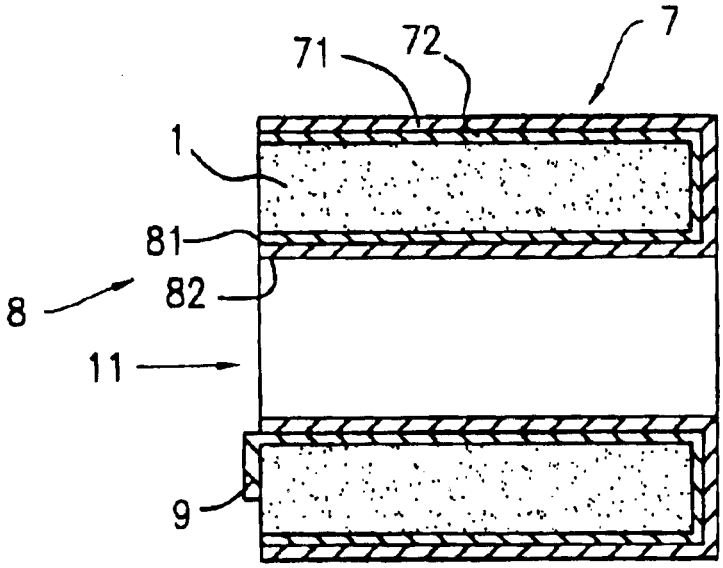
FIG. 10B is a sectional view of the dielectric coaxial resonator taken parallel to the axis of the through-hole.

FIG. 10A is a front view showing an open surface of the dielectric coaxial resonator in which the through-hole 11 is formed, and FIG. 10B is a sectional view of the dielectric coaxial resonator taken parallel to the axis of the through-hole 11.

Figure 8B:
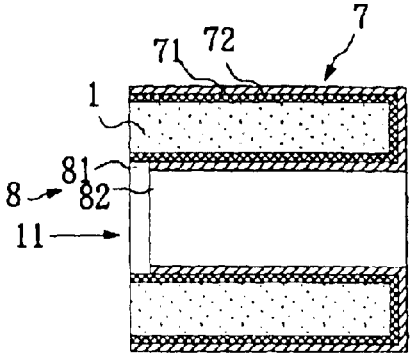
FIG. 8B is a sectional view of the dielectric coaxial resonator taken parallel to the axis of the through-hole.

In FIGS. 10A and 10B, reference numeral 9 represents an additional electrode, and the same parts as in FIGS. 8A and 8B are referred to with the same reference numerals.

The dielectric, superconductor, and metal used in the eighth embodiment are the same as in the first embodiment.

In the dielectric coaxial resonator shown in FIGS. 10A and 10B, the additional electrode 9 electrically connected to the inner conductor 8 is formed on the open surface in which the through-hole 11 is formed, and the superconducting film 81 and the metal film 82 are formed over the entire inner surface of the through-hole 11. The other configuration is the same as in the dielectric coaxial resonator shown in FIGS. 8A and 8B. The additional electrode 9 is composed of a superconductor. Thus, the resonance frequency can be readily adjusted, and a dielectric coaxial resonator having a resonance frequency that is not dependent on temperature can be readily formed, as in the seventh embodiment.

The configuration of a microstrip resonator according to a ninth embodiment of the present invention will now be described with reference to FIGS. 11A, 11B, and 11C.

Figure 11A:
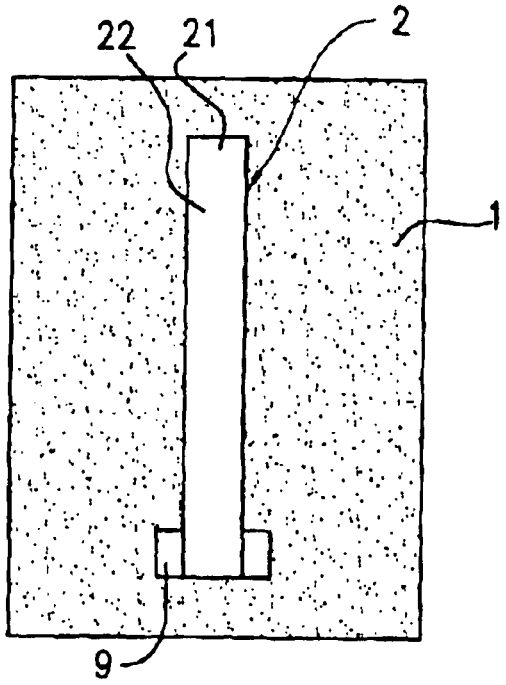
FIGS. 11A, 11B, and 11C are a top view, side view, and front view of a microstrip resonator according to a ninth embodiment of the present invention, respectively.
Figure 11B:
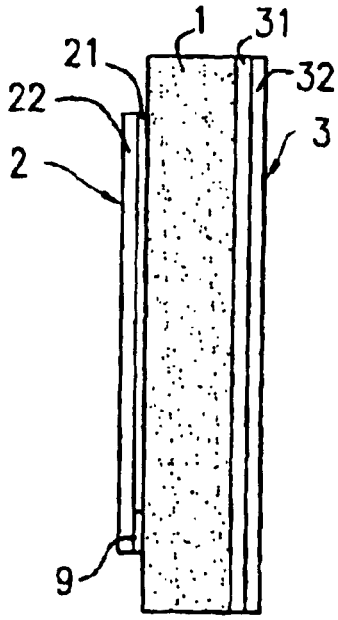
Figure 11C:
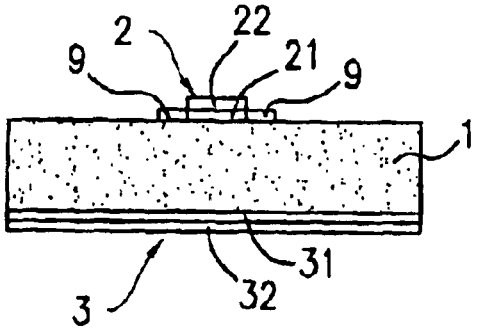

FIGS. 11A, 11B, and 11C are a top view, side view, and front view of the microstrip resonator, respectively.

The dielectric, superconductor, and metal used in the ninth embodiment are the same as in the first embodiment.

The resonance electrode 2 is formed on a first main surface of the dielectric substrate 1. The resonance electrode 2 comprises the superconducting film 21 and the metal film 22 deposited in that order from the first main surface of the dielectric substrate 1. The ground electrode 3 is formed over an entire second main surface of the dielectric substrate 1. The ground electrode 3 comprises the superconducting film 31 and the metal film 32 deposited in that order.

The longitudinal length of the resonance electrode 2 is an integral multiple of half the wavelength at the operating frequency, so that the resonator in which both ends in the longitudinal direction of the resonance electrode 2 are open is formed.

In addition, the additional electrodes 9 composed of superconductors are formed in a predetermined shape on one open end of the resonance electrode 2. The additional electrodes 9 are integrated with the superconducting film 21 of the resonance electrode 2 and are formed when the resonance electrode 2 is formed.

Arranging the additional electrodes 9 allows the area of the superconducting film 21 of the resonance electrode 2 to be greater than the metal film 22. Thus, a resonance frequency that is not dependent on temperature can be achieved, as in each of the foregoing embodiments.

Although the additional electrodes are formed only on one of the open ends in the ninth embodiment, the additional electrodes may be formed on each of the open ends. Furthermore, although the additional electrodes are connected to both sides of the resonance electrode, an additional electrode may be connected to only one side of the resonance electrode.

It is also possible for the similar additional electrode to be formed on an open end of the microstrip resonator in which one end of the resonance electrode is connected to the ground electrode through a through-hole or the like to be short circuited and the longitudinal length of the resonance electrode is equal to an odd multiple of one quarter the wavelength at the operating frequency.

The configuration of a microstrip resonator according to a tenth embodiment of the present invention will now be described with reference to FIGS. 12A, 12B, and 12C.

FIGS, 12A, 12B, and 12C are a top view, side view, and front view of the microstrip resonator, respectively.

Figure 12A:
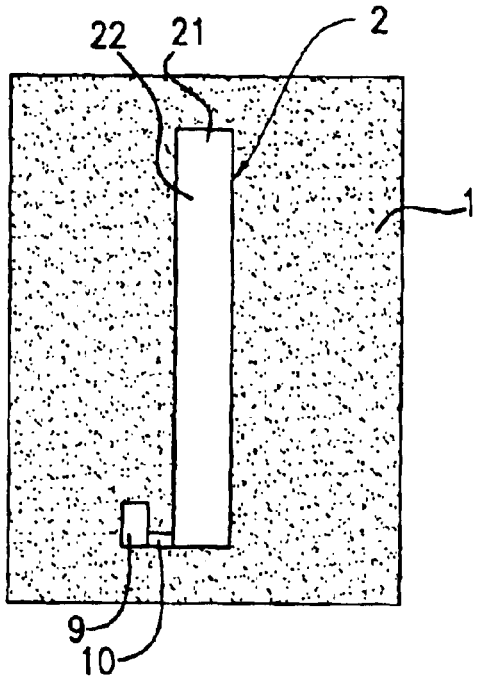
FIGS. 12A, 12B, and 12C are a top view, side view, and front view of a microstrip resonator according to a tenth embodiment of the present invention, respectively.
Figure 12B:
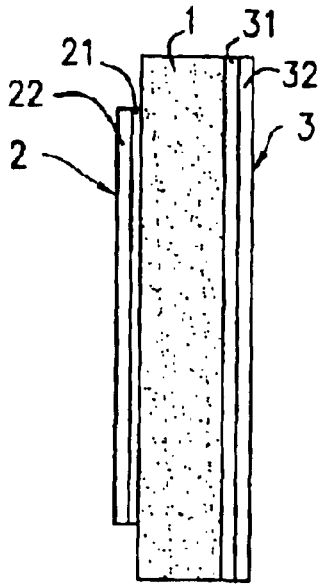
Figure 12C:
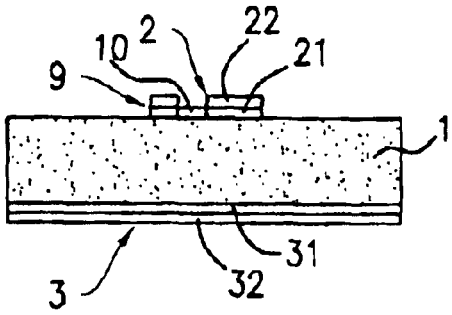

In FIGS. 12A to 12C, reference numeral 10 represents a contact electrode, and the same parts as in FIGS. 11A to 11C are referred to with the same reference numerals.

The dielectric, superconductor, and metal used in the tenth embodiment are the same as in the first embodiment.

In the microstrip resonator shown in FIGS. 12A to 12C, the additional electrode 9 is formed on one open end of the resonance electrode 2, with a contact electrode 10 composed of a superconductor therebetween. The additional electrode 9 comprises a superconductor and a metal. The other configuration is the same as in the resonator shown in FIGS. 11A to 11C. The superconductor of the additional electrode 9 and the contact electrode 10 are integrated with the superconducting film 21 of the resonance electrode 2 and are formed when the resonance electrode 2 is formed. The metal film of the additional electrode 9 is formed when the metal film 22 of the resonance electrode 2 is formed.

With the configuration described above, the similar advantages as in the ninth embodiment can be achieved. Also, by means of the additional electrode composed of a composite electrode of a metal film and a superconducting film, the area ratio can be precisely adjusted, and the resonance frequency in low-temperature operation and high-temperature operation can be set readily and precisely. Thus, a resonance frequency that is highly independent of temperature can be achieved. Since hardly any current flows in the additional electrode 9 and thus hardly any conductor loss is caused, the additional electrode 9 may be composed of a superconducting film or a metal film, instead of a layered electrode.

In the microstrip resonator according to the tenth embodiment, the position of the additional electrode and the contact electrode can be changed, as in the ninth embodiment. Also, the microstrip resonator may be a quarter-wavelength resonator.

The configuration of a microstrip filter according to an eleventh embodiment of the present invention will now be described with reference to FIG. 13.

Figure 13:
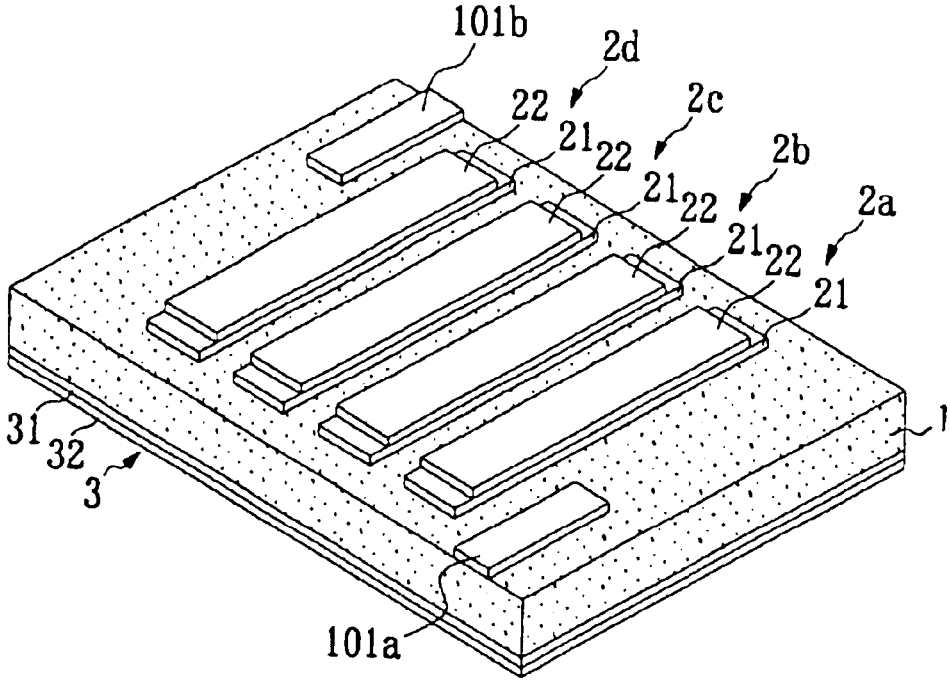
FIG. 13 is an external perspective view of a microstrip filter according to an eleventh embodiment of the present invention.

FIG. 13 is an external perspective view of the microstrip filter.

The dielectric, superconductor, and metal used in the eleventh embodiment are the same as in the first embodiment.

Resonance electrodes 2*a* to 2*d* are formed on a first main surface of the dielectric substrate 1. Each of the resonance electrodes 2*a* to 2*d* comprises the superconducting film 21 and the metal film 22 deposited in that order. The resonance electrodes 2*a* to 2*d* are separated from each other, with a predetermined space therebetween. The longitudinal length of each of the resonance electrodes 2*a* to 2*d* is equal to approximately half the wavelength at the operating frequency, and the metal film 22 is shorter than the superconducting film 21.

The ground electrode 3 is formed over an entire second main surface of the dielectric substrate 1. The ground electrode 3 comprises the superconducting film 31 and the metal film 32 deposited in that order. Thus, microstrip resonators are formed by the dielectric substrate 1, the ground electrode 3, and the corresponding resonance electrodes 2*a* to 2*d*.

Input-output electrodes 101*a* and 101*b* composed of superconducting films are formed near the resonance electrodes 2*a* and 2*d*, respectively. Thus, the input-output electrodes 101*a* and 101*b* are coupled to the resonator composed of the resonance electrode 2*a* and the resonator composed of the resonance electrode 2*d*, respectively.

With the configuration described above, a microstrip filter comprising four resonators composed of the resonance electrodes 2*a* to 2*d* and input-output electrodes can be formed. Since the resonance frequency of the resonator used in this filter is not dependent on temperature, the attenuation characteristics of the filter can also be made independent of temperature. Thus, a microstrip filter having excellent attenuation characteristics over a wide temperature range can be formed.

Although the resonance electrode used in the eleventh embodiment is formed as in the first embodiment, the resonance electrode and the additional electrode formed as in the second, ninth, and tenth embodiments may also be used.

Although the input-output electrode is composed of a superconducting film in the eleventh embodiment, the input-output electrode may be composed of a metal film, a layered electrode comprising a metal film and a superconducting film deposited in that order, or a composite electrode film composed of a mixture of a metal and a superconductor.

Although a filter provided with two input-output electrodes is used in the eleventh embodiment, a microstrip duplexer provided with two input-output electrodes and one common electrode may also be used.

The configuration of a dielectric coaxial filter according to a twelfth embodiment of the present invention will now be described with reference to FIG. 14.

Figure 14:
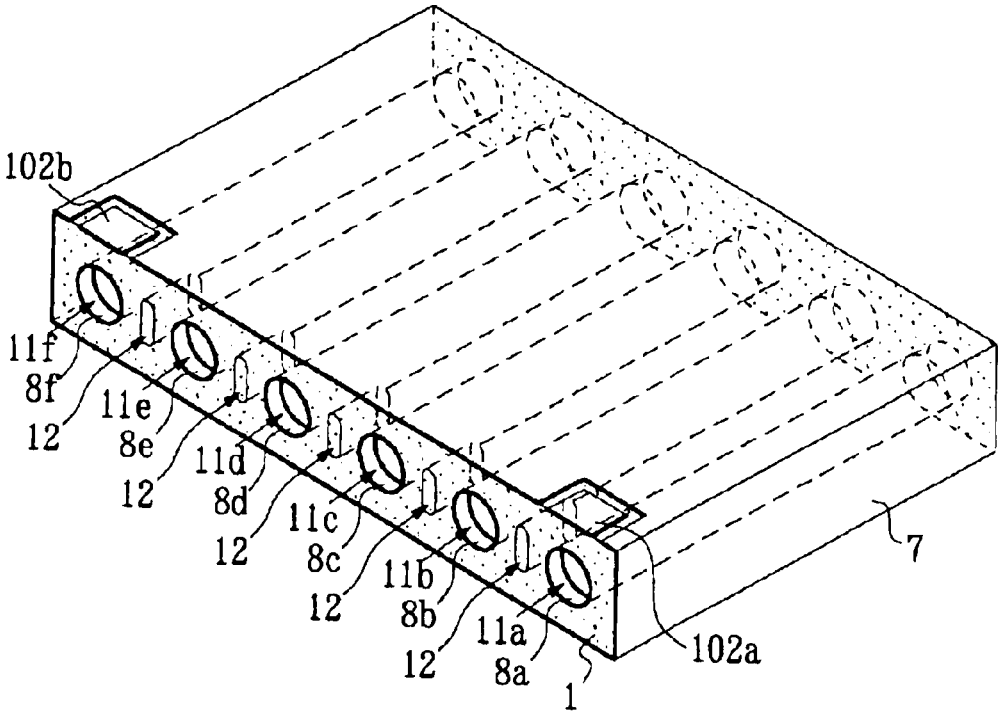
FIG. 14 is an external perspective view of a dielectric coaxial filter according to a twelfth embodiment of the present invention.

FIG. 14 is an external perspective view of the dielectric coaxial filter.

The dielectric, superconductor, and metal used in the twelfth embodiment are the same as in the first embodiment.

Through-holes 11*a* to 11*f* extend from a surface of the dielectric substrate 1 to an opposing surface. Inner conductors 8*a* to 8*f* are formed on inner surfaces of the through-holes 11*a* to 11*f*, respectively. The inner conductors 8*a* to 8*f* are layered electrodes and they each comprise a superconducting film and a metal film deposited in that order. The superconducting film is formed over the entire inner surface in which each of the through-holes 11*a* to 11*f* is formed. In contrast, the metal film is not formed on the inner surface from surfaces in which each of the through-holes 11*a* to 11*f* is formed to positions at a predetermined depth from the surfaces. Also, the axial length of the through-holes 11*a* to 11*f* (length of the dielectric substrate 1) is equal to substantially half the wavelength at the operating frequency.

The outer conductor 7 is formed on substantially the entire four outer surfaces of the dielectric substrate 1 other than the surfaces in which the through-holes 11*a* to 11*f* are formed. The outer conductor 7 is a layered electrode and comprises a superconductor and a metal deposited in that order from the outer surfaces of the dielectric substrate 1. Coupling holes 12 with a predetermined depth are formed between the through-holes 11*a* to 11*f* in one surface of the dielectric substrate 1 in which the through-holes 11*a* to 11*f* are formed.

As described above, the ends of each of the inner conductors 8*a* to 8*f* are open. Thus, half-wavelength resonators are formed by the dielectric substrate 1, the outer conductor 7, and the corresponding inner conductors 8*a* to 8*f*. The resonators are coupled to each other via the coupling holes 12 to form a six-stage resonator.

Input-output electrodes 102*a* and 102*b* coupled to the resonator composed of the inner conductor 8*a* and the resonator composed of the inner conductor 8*f*, respectively, are formed on the outer surface of the dielectric substrate 1, and the entire dielectric substrate 1 functions as an integrated dielectric coaxial filter. The configuration of the input-output electrodes 102*a* and 102*b* is the same as in the outer conductor 7.

Thus, a filter with a resonator that is not dependent on temperature can be formed, as described above. A dielectric coaxial filter having excellent transmission characteristics that are not dependent on temperature can therefore be achieved.

Although a half-wavelength resonator is used in the twelfth embodiment, a quarter-wavelength resonator, one end in which a through-hole is formed being short circuited, may also be used. Also, a resonator in which an additional electrode is formed on an open end may also be used.

Also, a similar electrode arrangement may be applied to a composite filter apparatus, such as a duplexer or a triplexer in which a plurality of input-output electrodes and a common electrode are formed on an outer surface of the dielectric substrate 1. Similar advantages can be achieved by such a composite filter apparatus.

A low-temperature receiving apparatus according to a thirteenth embodiment of the present invention will now be described with reference to FIG. 15.

Figure 15:
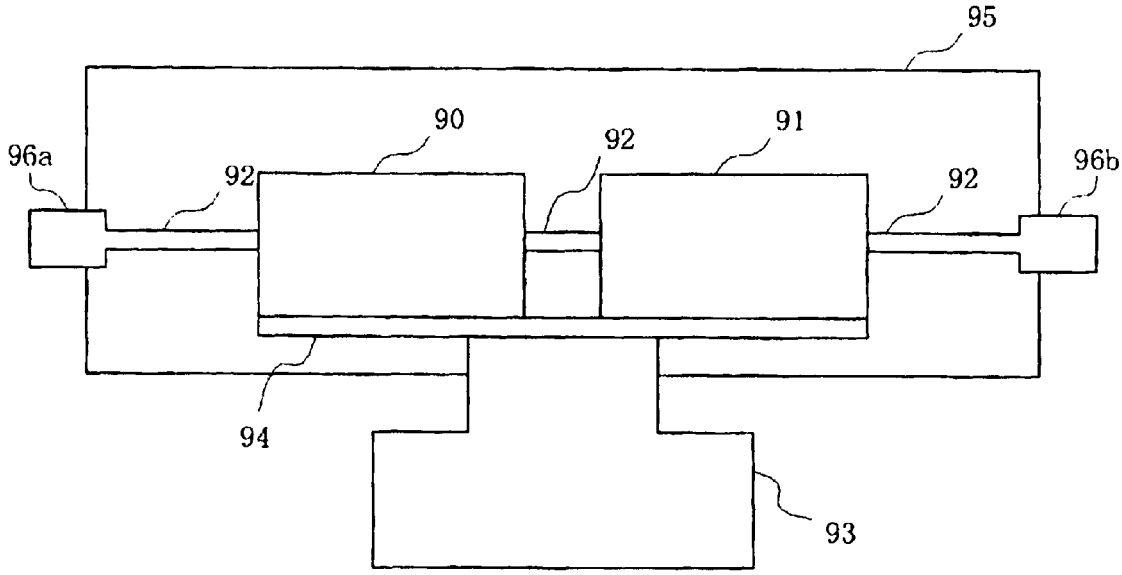
FIG. 15 is a schematic illustration of a low-temperature receiving apparatus according to a thirteenth embodiment of the present invention.

FIG. 15 is a schematic illustration of the low-temperature receiving apparatus.

A filter 90 and a low-noise amplifier (LNA) 91 connected to each other, with one of insulating RF cables 92 therebetween, are disposed on a cooling stage 94. A cooler 93 is connected to the cooling stage 94 to cool the cooling stage 94 to a predetermined temperature. The filter 90, the LNA 91, and the cooling stage 94 are disposed within a vacuum-insulated container 95 in order to control the filter 90 and the LNA 91 to a predetermined low temperature.

The filter 90 and the LNA 91 are connected to hermetic connectors 96*a* and 96*b*, respectively, with the insulating RF cables 92 therebetween. Thus, the filter 90 and the LNA 91 are connected to an external circuit, with the hermetic connectors 96*a* and 96*b* therebetween, respectively.

Signals received from the external circuit via the hermetic connector 96*a* are transmitted to the filter 90 via the insulating RF cable 92. Only signals within a required frequency range pass through the filter 90 to be transmitted to the LNA 91 via the insulating RF cable 92. The LNA 91 amplifies the transmitted signals to output them to the external circuit in the subsequent stage via the insulating RF cable 92 and the hermetic connector 96*b*.

Cooling the entire receiving apparatus to be lower than the critical temperature of the superconductor by the cooler 93 allows the main electrode of the filter to become a superconducting film. Thus, a receiving apparatus which reduces conductor loss and which has excellent communication characteristics can be achieved.

The filter shown in the embodiments described above can be used for the filter 90 shown in FIG. 15.

If the cooler 93 does not properly operate for some reason, the temperature of the entire receiving apparatus increases. If the temperature of the electrode becomes equal to or higher than the critical temperature, the metal film operates as a main electrode, thus increasing the conductor loss. The increase in the conductor loss is, however, suppressed as compared to the case in which an electrode made of only a superconductor is provided. Furthermore, since the area of the superconducting film is greater than that of the metal film, the frequency characteristics of the filter can be maintained substantially constant.

Since a low-temperature transmitting apparatus comprises a filter and an amplifier, a configuration similar to the low-temperature receiving apparatus described above can be applied to the low-temperature transmitting apparatus. Moreover, a transmitting and receiving apparatus which has a transmitting function and a receiving function can also be configured like the low-temperature receiving apparatus.

Although an amplifier is connected to an output terminal of a filter in the thirteenth embodiment, the amplifier may be connected to an input terminal of the filter.

A communication apparatus according to a fourteenth embodiment of the present invention will now be described with reference to FIG. 16.

Figure 16:
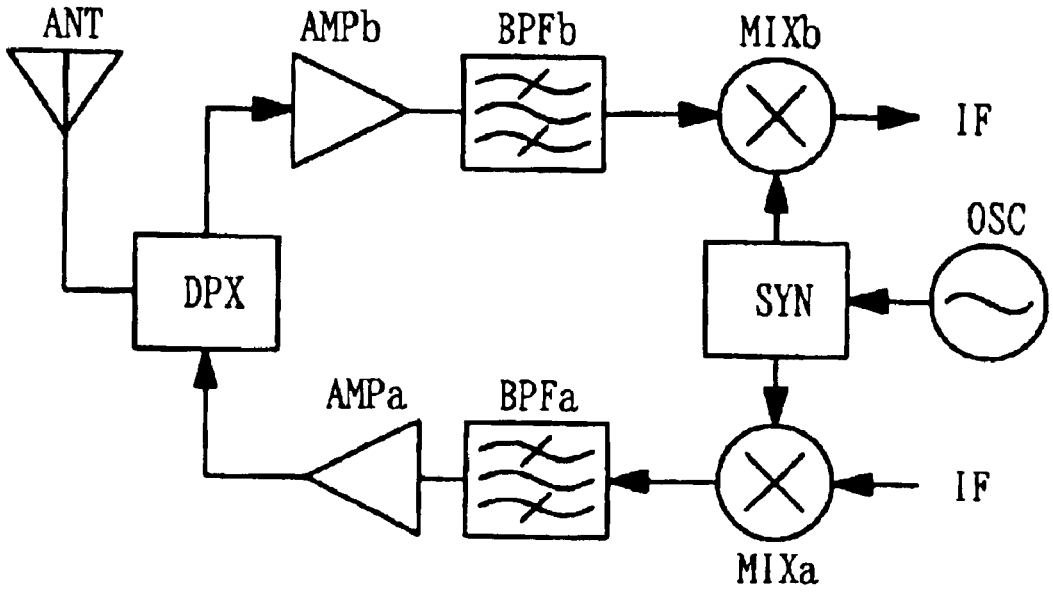
FIG. 16 is a block diagram of a communication apparatus according to a fourteenth embodiment of the present invention.
Figure 17A:
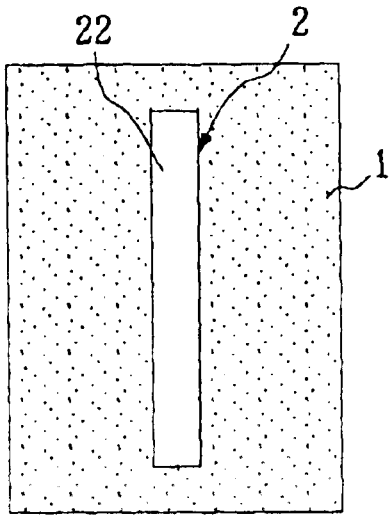
FIG. 17A PRIOR ART
FIG. 17A is a top view of a conventional microstrip resonator.
Figure 17B:
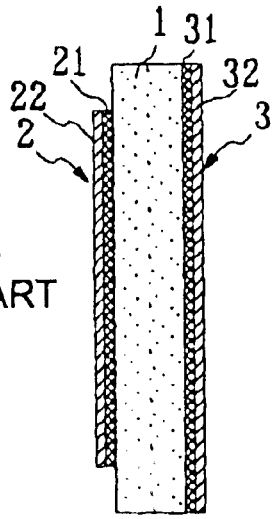
FIG. 17B PRIOR ART
FIG. 17B is a sectional view of the microstrip resonator taken along the longitudinal direction.
Figure 17C:
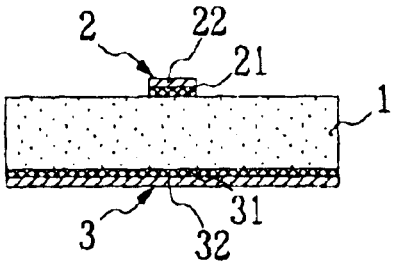
FIG. 17C PRIOR ART
FIG. 17C is a sectional view of the microstrip resonator taken along the lateral direction.
Figure 18:
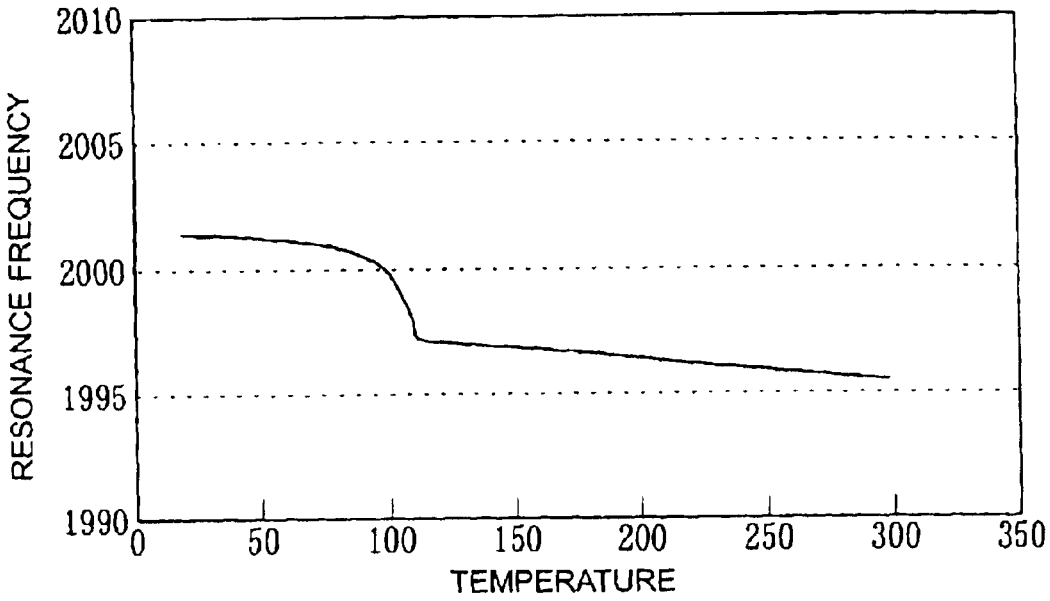
FIG. 18 PRIOR ART
FIG. 18 is a graph showing the temperature characteristics of the resonance frequency of the conventional resonator.

FIG. 16 is a block diagram of the communication apparatus. Referring to FIG. 16, ANT represents a transmitting and receiving antenna and DPX represents a duplexer. BPFa and BPFb represent band pass filters, AMPa and AMPb represent amplifying circuits, and MIXa and MIXb represent mixers. Also, OSC represents an oscillator, SYN represents a synthesizer, and IF represents an intermediate frequency signal. The MIXa modulates frequency signals output from the SYN using IF signals. Only signals within a transmitting frequency range pass through the BPFa. The AMPa power-amplifies the signals to be transmitted from the ANT via the DPX. The AMPb power-amplifies the signals output from the DPX and only signals within a receiving frequency range pass through the BPFb. The MIXb mixes the frequency signals output from the SYN and the receiving signals output from the BPFb to output an intermediate frequency signal IF.

The duplexer and the filter having the configuration described in the foregoing embodiments may be used as the duplexer DPX shown in FIG. 16. Also, the filter having the configuration described in the foregoing embodiments may be used as the filters BPFa and BPFb. Furthermore, the low-temperature transmitting apparatus and the low-temperature receiving apparatus having the configuration described in the foregoing embodiments may be used for the combination of the BPFa and AMPa, and the AMPb and BPFb. Thus, a communication apparatus having excellent communication characteristics can be formed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A resonator comprising:

a dielectric; and a layered electrode formed on the dielectric, the layered electrode including;

a superconducting film that operates as a main conductor below a critical temperature at a first resonance frequency; and a metal film that operates as the main conductor at or above the critical temperature at a second resonance frequency, wherein each of the superconducting film and the metal film has at least one of a position, shape, and size so that the first resonance frequency below the critical temperature is substantially equal to the second resonance frequency at or above the critical temperature.

2. The resonator according to claim 1, wherein an area of the metal film is smaller than an area of the superconducting film.

3. The resonator according to claim 1, further comprising an additional electrode, the additional electrode being composed of the superconducting film and being formed near an open end of the resonator.

4. The resonator according to claim 2, further comprising an additional electrode, the additional electrode being composed of the superconducting film and being formed near an open end of the resonator.

5. The resonator according to claim 1, further comprising:

an additional electrode, the additional electrode being composed of at least one of the metal film and the superconducting film; and a contact electrode connecting the additional electrode to the vicinity of an open end of the resonator, the contact electrode being composed of the superconducting film.

6. The resonator according to claim 2, further comprising:

an additional electrode, the additional electrode being composed of one at least of the metal film and the superconducting film; and a contact electrode connecting the additional electrode to the vicinity of an open end of the resonator, the contact electrode being composed of the superconducting film.

7. The resonator according to claim 1, wherein a dielectric constant of the dielectric exhibits a negative temperature coefficient.

8. A resonator comprising:

a dielectric; and an electrode formed on the dielectric, the electrode including:

a superconducting film that operates as a main conductor below a critical temperature at a first resonance frequency; and a composite film comprising a mixture of a superconductor and a metal, the superconductor of the composite film operating as the main conductor below the critical temperature at the first resonance frequency, and the metal of the composite film operating as the main conductor at or above the critical temperature at a second resonance frequency, wherein each of the composite film and the superconducting film has at least one of a position, shape, and size so that the first resonance frequency below the critical temperature is substantially equal to the second resonance frequency at or above the critical temperature.

9. The resonator according to claim 8, further comprising an additional electrode, the additional electrode being composed of the superconducting film and being formed near an open end of the resonator.

10. The resonator according to claim 8, further comprising:

an additional electrode, the additional electrode being composed of at least one of the superconducting film and the composite electrode film; and a contact electrode connecting the additional electrode to a vicinity of an open end of the resonator, the contact electrode being composed of the superconducting film.

11. The resonator according to claim 8, wherein a dielectric constant of the dielectric exhibits a negative temperature coefficient.

12. A filter comprising:

a plurality of the resonators as set forth in claim 1; and a plurality of input-output means for coupling to the respective resonators.

13. A duplexer comprising:

a plurality of the filters as set forth in claim 12; and a plurality of input-output means for coupling to the respective filters.

14. A transmitting and receiving apparatus comprising:

the filter as set forth in claim 12;

an amplifier connected to an input unit or an output unit of the filter; and a refrigerator to cool the filter to a temperature below the critical temperature.

15. A communication apparatus comprising the filter as set forth in claim 12.

* * * * *